United States Patent [19]

Schmidt et al.

[11] 3,978,986

[45] Sept. 7, 1976

[54] PROCESS AND APPARATUS FOR SEPARATING ASPHERICAL PARTICLES FROM SPHERICAL PARTICLES

[75] Inventors: Hartmut Schmidt, Wiesbaden-Bierstadt; Jürgen Neumann, Russelsheim; Reinhold Arneth, Budenheim, all of Germany

[73] Assignee: Hoechst Aktiengesellschaft, Frankfurt am Main, Germany

[22] Filed: Oct. 31, 1974

[21] Appl. No.: 519,661

[30] Foreign Application Priority Data

Nov. 5, 1973 Germany ..... 2355135

[52] U.S. Cl. ..... 209/112; 209/116

[51] Int. Cl.[2] ..... B07C 9/00

[58] Field of Search ..... 209/112, 114, 115, 116, 209/117, 470, 477, 480, 481, 483

[56] References Cited

UNITED STATES PATENTS

| | | | |
|---|---|---|---|
| 977,956 | 12/1910 | Langerfeld | 209/116 |
| 1,094,621 | 4/1914 | Ayres | 209/117 |
| 1,292,820 | 1/1919 | Lindsley | 209/114 |
| 1,315,880 | 9/1919 | Sutton | 209/480 |
| 2,658,616 | 11/1953 | Stutzman | 209/112 |

*Primary Examiner*—Robert B. Reeves
*Assistant Examiner*—H. Grant Skaggs
*Attorney, Agent, or Firm*—Bacon & Thomas

[57] ABSTRACT

Disclosed is a process and apparatus for separating aspherical particles from spherical particles in an admixture thereof, preferably in the preparation of a particulate carrier material for two-component developer systems for electrostatic copy devices. The process comprises directing the mixture of particles onto a surface which is inclined with respect to the horizontal; producing a relative velocity between the inclined surface and the mixture of particles, the velocity having a directional component transverse to the steepest inclination gradient of the inclined surface; and collecting a portion of the mixture of particles in a zone of the inclined surface wherein predominantly spherical particles have accummulated as a result of their greater tendency to roll in response to the relative velocity than the aspherical particles.

1 Claim, 6 Drawing Figures

PROCESS AND APPARATUS FOR SEPARATING ASPHERICAL PARTICLES FROM SPHERICAL PARTICLES

BACKGROUND OF THE INVENTION

The present invention relates to a process and apparatus for separating aspherical particles from spherical particles, and more especially, to a process and apparatus for separating aspherical particles from spherical particles which both consist of organic or inorganic material, the spherical particles being used as the carrier material for the toner of electrophotographic developer substances.

It is conventional in electrophotographic processes to produce a latent image on a photoelectrically conductive recording material. This electrostatic image is made visible or developed by means of a toner, which is applied to the surface of the recording material. The toner particles must likewise be charged electrostatically with a polarity opposite to the charge polarity of the latent electrostatic image. To charge the surface of the toner electrostatically, the toner is mixed with a carrier material which is selected so that, by surface charging, the appropriate electric charge of the toner is produced when the toner and carrier are separated from one another. When this developer mixture is scattered onto the recording material by a suitable application system, the toner separates from the carrier material and, due to its opposite polarity, adheres to the recording material solely in areas where charges in the form of the latent electrostatic image are still present.

The image made visible or developed in this manner with the toner is then contact-transferred to a carrier, for example, a paper sheet. Subsequently, the toner image which is relatively loose on the paper sheet is fixed so as to render the image permanent.

Although images and/or copies of good quality are produced by means of the electrophotographic processes, such copies often have transfer defects in the form of blurred image areas as a result of non-uniform color density. These transfer defects may be caused by various reasons. One of these reasons is indirectly due to the carrier material mixed with the toner.

During development of a latent electrostatic image on the recording material, the individual carrier particles provided with toner roll over the recording material in response to gravitational forces. The recording material is arranged so that the carrier particles give up the toner particles transported with them to the still-existing electrostatic charge areas but themselves do not remain on the recording material. Instead, they roll on into a toner supply container. It frequently occurs, however, that individual carrier particles remain on the recording material. The result is that the carrier particles, which are much larger than the toner particles, form real elevations on the recording material. When the toner image is then transferred by direct contact for final use, for example, onto a paper sheet, intimate contact between the toner and the paper in the immediate vicinity of these carrier particles is then interrupted by the elevations. The paper which, as is known, is also statically charged, is thus not capable of attracting the toner particles arranged around the carrier particles. Missing image areas or non-uniform color density are the result of such remaining carrier particles. Transfer defects of this type become particularly disadvantageously noticeable when literature is copied, particularly literature with numerical tables and mathematical formulae. Therefore, these defects must be avoided.

As carrier materials, there have been suggested organic and inorganic materials. In practice, glass and iron have proven to be suitable inorganic materials. The carriers are used in particulate form having a preferable grain size of about 200 to 600$\mu$. The average grain size of the toner, on the other hand, is only about 10 to 60$\mu$.

The ideal geometrical form of the carrier particles is that of a sphere. For practical and economical reasons, the carrier material, however, cannot be produced in such ideal grain configuration. Rather the carrier consists of a mixture of nearly spherical particles and of particles having random geometrical form. For the sake of simplicity, the nearly spherical particles are hereinafter called spherical particles and the particles deviating therefrom are called aspherical particles.

Of particularly great disadvantage are the aspherical particles contained in the mixture. They are present in the form of small rods, ellipsoids or the like, which additionally are provided with sharp points or sharp edges. In the hitherto known production processes, the approximate proportion of aspherical particles is about 15 to 30 percent.

Transfer defects can be prevented if it would be possible to completely separate the aspherical carrier particles from the spherical carrier particles. It has been found that the carrier particles which remain on the photoelectrically conductive recording material belong exclusively to the aspherical category. Because of their non-uniform surface, they tend to remain much more than the carrier particles of the spherical category.

Another not insignificant disadvantage results from the sharp edges and points of the aspherical carrier particles. During development of the latent image, they cause fine scratches on the surface of the recording material, and in the scratched areas electrostatic charging is no longer possible, and thus, the toner can no longer adhere there. The transfer defects resulting therefrom become particularly noticeable when the recording material has been used for the production of several hundred copies. Since the recording material, however, normally can be used for producing several thousand copies, it must be prematurely replaced and is not used to its fullest economic extent. Even those carrier particles which for certain reasons are often additionally provided with a fine coating of plastic are no exception, because the plastic material does not adhere to the sharp points and edges.

SUMMARY OF THE INVENTION

It is therefore an object of the present invention to provide a process for separating aspherical particles from spherical particles in an admixture thereof, as well as to provide a simple and inexpensive apparatus for carrying out this process.

It is a particular object of the present invention to provide a method and apparatus for separating aspherical particles from the carrier material adapted for use in two-component developer mixtures for electrostatic copying devices.

In accomplishing the foregoing objects, there has been provided in accordance with the present invention a process for the separation of spherical particles from aspherical particles in an admixture thereof, comprising the steps of (a) directing the mixture of particles onto a surface which is inclined with respect to the horizontal; (b) producing a relative velocity between the inclined surface and the mixture of particles, this velocity having a directional component transverse to the steepest inclination gradient of the inclined surface; and (c) collecting a portion of the mixture of particles in a zone of the inclined surface wherein predominantly spherical particles have accummulated as a result of their greater tendency to roll in response to the relative velocity than the aspherical particles. Production of a relative velocity between the particles and the surface may be accomplished either by moving the surface, propelling the particles upon the surface or using gravitational forces coupled with appropriate design of the surface.

There has also been provided in accordance with the invention an apparatus for separating spherical particles from aspherical particles in an admixture thereof, comprising (a) a base member; (b) a separating surface secured to the base member at an inclined angle with respect to horizontal; (c) means for directing the mixture of particles upon the inclined surface; (d) means for producing a relative velocity between the inclined surface and the particles, this velocity having a directional component transverse to the steepest inclination gradient of the inclined surface; and (e) means positioned relative to the inclined surface for collecting a portion of the particles in a zone of the surface wherein predominantly spherical particles have accummulated as a result of their greater tendency to roll in response to the aforesaid relative velocity than the aspherical particles.

In the process of the invention, the aspherical carrier particles are separated in a simple manner from the spherical particles. In the case of approximate proportion of 30 percent of aspherical particles in a typical mixture, at least 25 percent of aspherical particles are sorted out in one process operation. The remaining 5 percent may be reduced, for example, by a repeated process operation. Generally, however, one process operation is completely sufficient to sort out with sufficient accuracy the roughly aspherical particles causing transfer defects.

It surprisingly has been found that, by this process, in which a dense stream of carrier particles is passed over a sloping surface, and in which the particles influence one another, particularly by pushing, a considerable enrichment of spherical particles with a very good yield can be achieved. It is important that the particles do not pass undisturbed in separate paths but stream relatively densely and often contact one another, whereby a reasonable throughput and an economical performance of the process are possible.

The apparatus for carrying out the process is preferably characterized in that an endless conveyor belt is passed around a driving shaft and guide shaft, in that the driving shaft and the guide shaft are distanced from one another and arranged on a pivotable frame, in that the frame, together with the conveyor belt, may have an inclined position in a certain preferable zone, so that the conveyer belt driven via the driving shaft can be moved transversely to its inclined plane, and in that, at the highest point of the inclined conveyer belt, there is a reciprocating dosing device with a supply container.

Other objects, features and advantages of the invention will become apparent from the following detailed description of several specific embodiments of the invention, when considered with the attached sheets of drawing.

DETAILED DESCRIPTION OF SPECIFIC EMBODIMENTS

Figure 1:
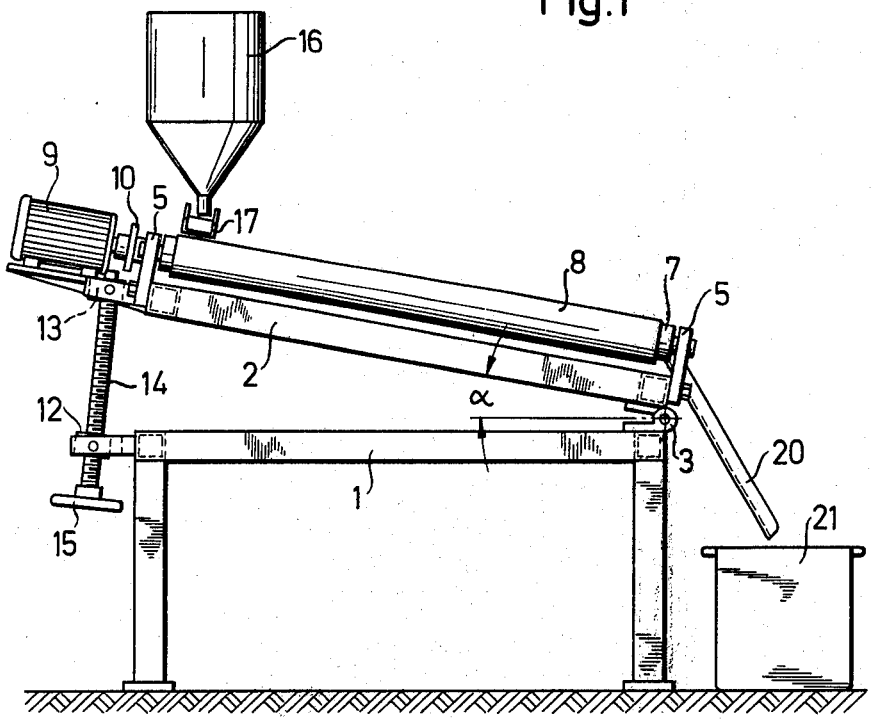
FIG. 1 is a side elevational view of an apparatus for performing of the process of the invention.
Figure 2:
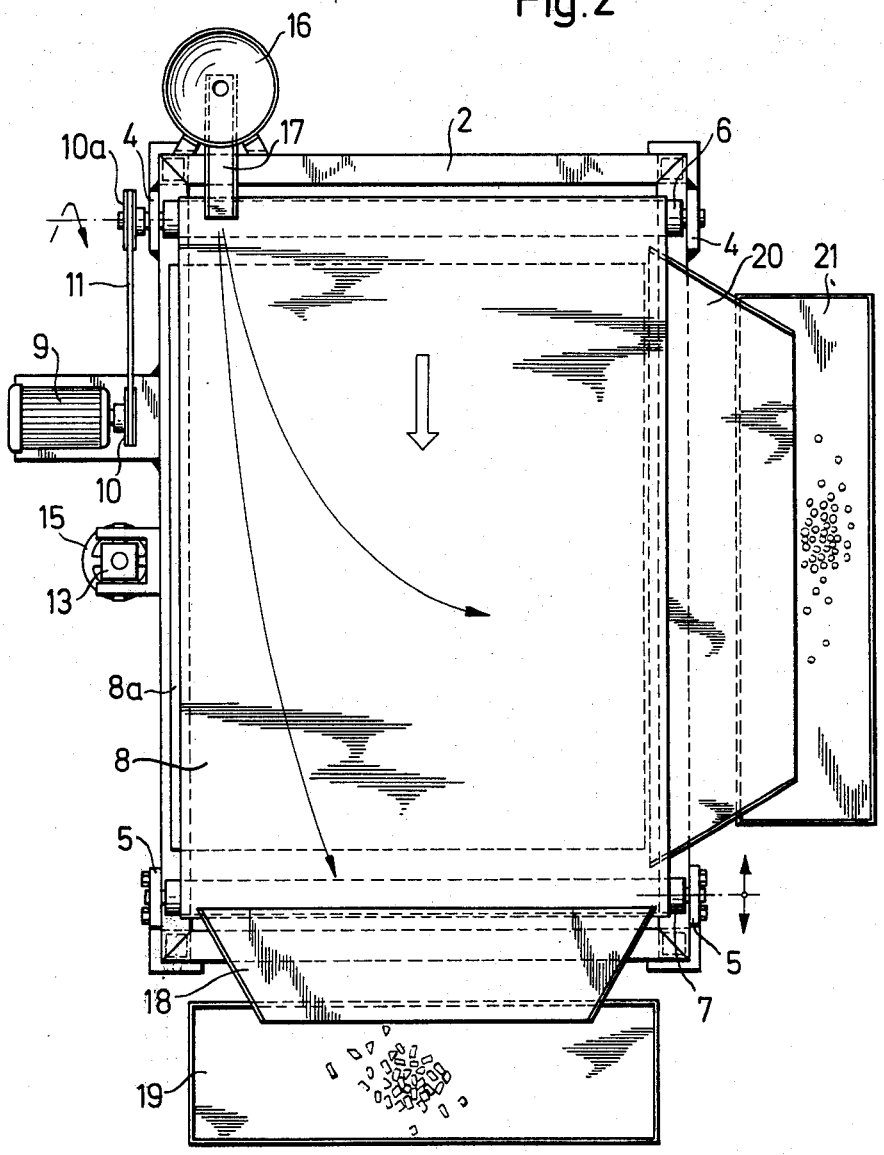
FIG. 2 is a top view of the apparatus shown in FIG. 1.

Referring now to the drawings, the apparatus according to FIGS. 1 and 2 has a solid base 1 to which a frame 2 is secured at one end by means of hinges 3. Two stationary bearings 4 and two movable bearings 5 are positioned opposite to one another and are connected with flanges to the frame 2, which bearings carry respectively a driving shaft 6 and a guide shaft 7 spaced from one another. An endless conveyer belt 8 is passed at one end around the driving shaft 6 and at the other end around the guide shaft 7.

For driving the conveyor belt 8 and for performing the process of the invention, the conveyer belt 8 is tightened in the conventional manner (not illustrated) by means of the movable bearings 5 and the guide shaft 7. The tightened conveyer belt 8 is driven by means of an adjustable electromotor 9 via two V-belt pulleys 10 and 10*a*, via a V-belt 11 as well as via the driving shaft 6. "Driven" means uniformly, continuously moved. A supporting plate 8*a* prevents sagging of the upper strand of the belt during the particle separating procedure.

In the middle between the driving shaft 6 and the guide shaft 7, on the side opposite the hinges 3, a threaded nut 12 is secured to the base 1 and a spindle bearing 13 is secured to the frame 2. A threaded spindle 14 passing through the threaded nut 12 is rotatable at its one end in the spindle bearing 13. By means of the hand wheel 15 mounted at the other end of the threaded spindle 14, the threaded spindle 14 can be rotated via the threaded nut 12 and via the spindle bearing 13 so that the frame 2, with the conveyer belt 8 arranged thereon, can take any inclined position within a certain range of inclination $\alpha$. The threaded nut 12 and the spindle bearing are pivotable for this purpose so that they can be adapted, together with the threaded spindle 14, to the individual inclination angle of the frame 2.

A funnel-shaped supply container 16 is arranged at the highest point and at the upper end of the inclined conveyer belt 8. The funnel discharges into a reciprocating dosing device 17 which is arranged closely above the conveyer belt 8. The outlet of the dosing device extends in the direction of belt transport. At the lower end, a trapezoidal collecting trough 18 is mounted on the frame 2 and extends obliquely downward into a collecting container. The longer parallel side of the trough 18 corresponds to the width conveyer belt 8. The upper end of the conveyer belt 8 is that side on which it is driven. For the sake of simplicity, the collecting trough 18 and the collecting container 19 are not shown in FIG. 1. Another trapezoidal collecting trough 20 is arranged at the lowest point of the conveyer belt inclination and is also mounted on the frame 2 between the driving shaft 6 and the guide shaft 7. It too extends obliquely downward onto the collecting container 21. The longer parallel side of the collecting trough 20 substantially corresponds to the length of the conveyer belt 8.

The carrier material to be treated according to the process of the invention passes from the supply container 16 into the reciprocating dosing device 17. From there, it flows from the highest point of the belt inclination onto the uniformly moving conveyer belt 8. The spherical particles roll downward on the inclined plane of the conveyer belt 8 due to their uniform rolling tendency and are collected via the collecting trough 20 in the collecting container 21 beneath. Simultaneously, the aspherical carrier particles are taken by the conveyer belt 8 moving transversely to the plane of inclination and are conveyed via the collecting trough 18 into the collecting container 19. Due to their geometrical form, they have no significant tendency to roll and thus remain on the conveyer belt 8 without sliding down on the inclined surface.

It cannot be avoided that now and then aspherical carrier particles are carried downward into the collecting container 21 by the spherical carrier particles on the inclined conveyer belt. By suitable measures, however, this can be reduced to a minimum, e.g., by arranging the reciprocating dosing device 17 closely above the conveyer belt 8 so that the speed at which the carrier material impinges upon the conveyer belt 8 is as low as possible. Furthermore, the dimensions of the apparatus are preferably in a certain relation to one another, which can be easily determined by tests for a given conveyer belt size.

With an apparatus having a 1 m long (distance between driving shaft 6 and guide shaft 7) and 80 cm wide smooth conveyer belt driven at a speed of 6 m/min and set at an angle of $\alpha = 12°$ with respect to the horizontal, it is possible to treat about 50 kg of granulated iron as the carrier material per hour. For example, a mixture consisting of about 70 percent of spherical and about 30 percent of aspherical carrier particles was treated therewith. Already after the first process operation, the carrier material collected in the collecting container 21 contained only 5 percent carrier particles of the aspherical category. Another process operation yielded a further improvement.

Tests have shown that the apparatus operates particularly successfully within an inclination range of about 6° to 8° for the belt with respect to the horizontal at a belt speed of 3 to 7 m/min. These ranges are preferable for polyester belts. Belt inclination and belt speed depend on the selected size and surface roughness of the conveyer belt. Suitable conveyer belts are textile belts, plastic belts, and metal belts. Choice of suitable belt size, material and angle of inclination may be readily determined by the artisan.

Figure 3A:
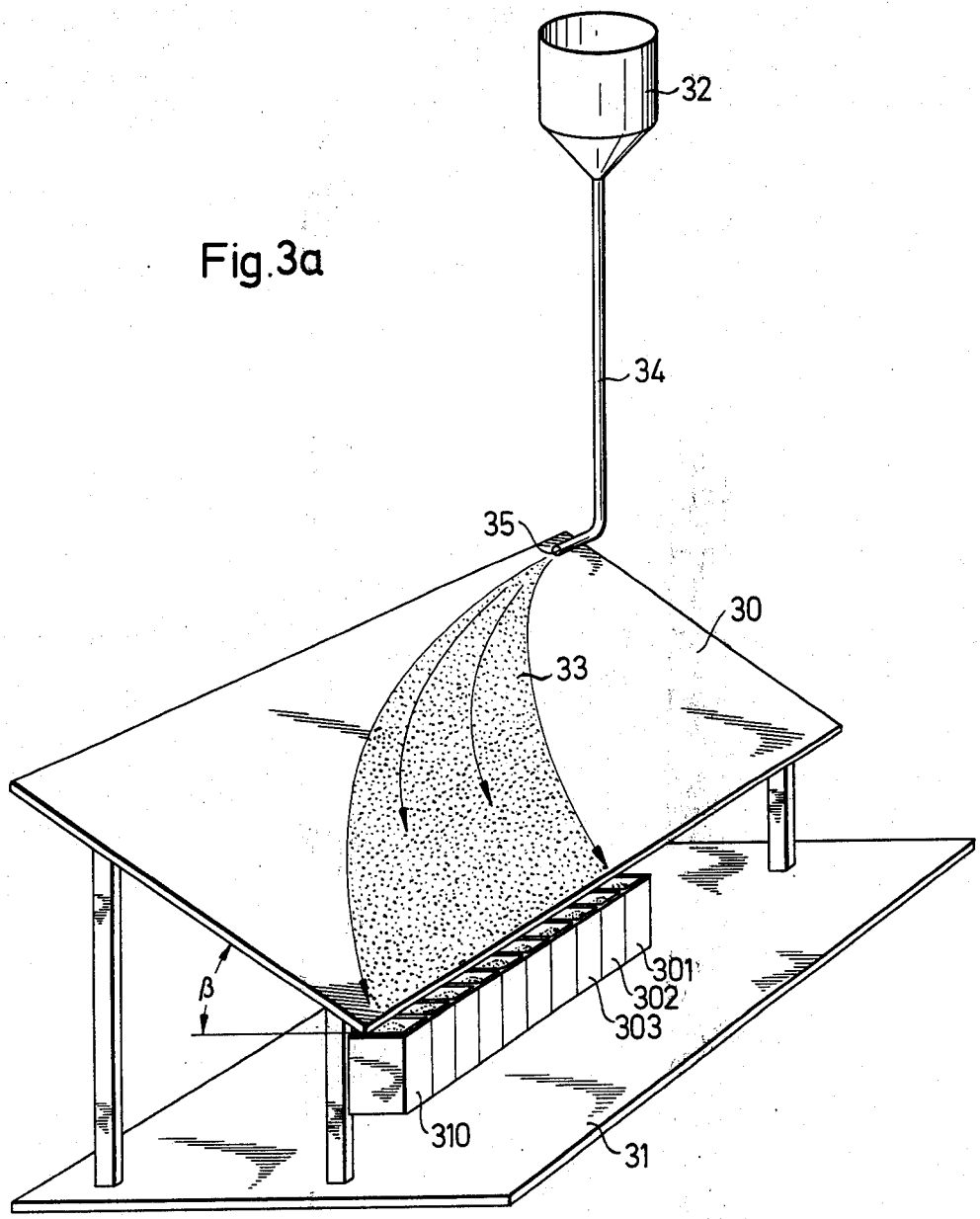
FIG. 3*a* is a perspective view of another apparatus for performing the process of the invention.

Another exemplary embodiment of an apparatus for the performance of the process of the invention is shown in FIG. 3*a*. This embodiment uses a stationary plate 30 instead of a moving belt. This stationary plate 30 is set at a certain angle $\beta$ with respect to a horizontal plane, e.g., a table plate 31. From a supply funnel 32, carrier material 33 falls through conduit means specifically embodied by a gravity tube 34 and, at outlet means specifically embodied by the nozzle orifice 35, impinges upon the plate in a substantially horizontal direction. The carrier particles densely leaving the nozzle orifice 35 move on the plate 30 in curved downward paths determined by their initial speed and the gravity.

Figure 4:
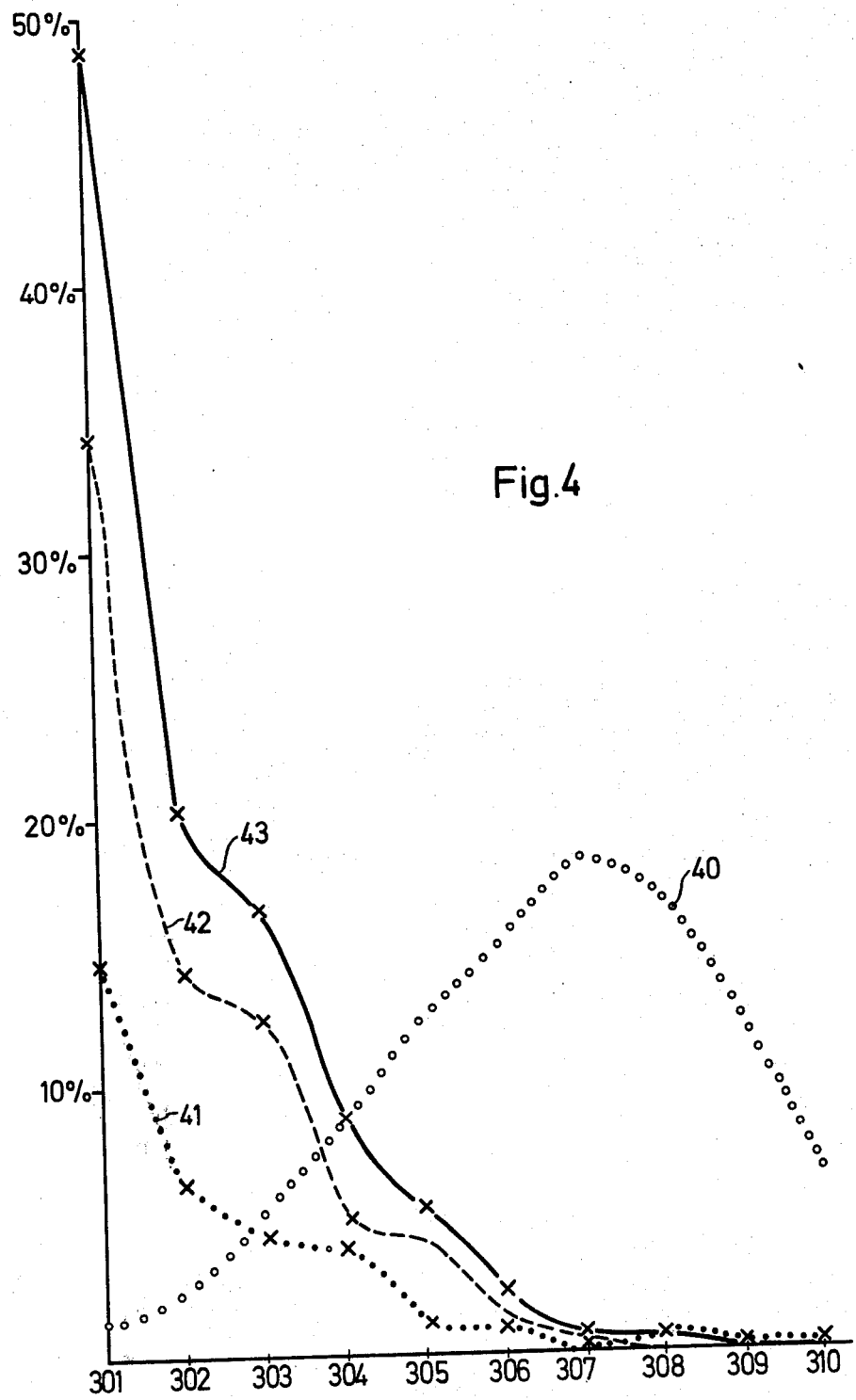
FIG. 4 is a graph of a test result.

The carrier particles are collected in ten collecting containers 301 to 310, with the receiving apertures facing the plate 30 all having the same size. The test for the collected carrier particles are shown in FIG. 4. The abscissa shows the numbers of the collecting containers 301 to 310. The ordinate shows the percentage of aspherical particles of the carrier material collected in the individual containers 301 to 310. The procedure was carried out with granulated iron containing 8.2 percent aspherical particles. The curve 40 represents the weight distribution of the material collected in the collecting containers 301 to 310. The curve 41 shows the percentages of "somewhat aspherical" particles in the collecting containers 301 to 310, whereas the curve 42 shows the percentages of the "grossly aspherical" particles in the individual collecting containers. The curve 43 is the sum of both curves 41 and 42, i.e., it shows the total percentage of aspherical particles in the individual containers. In this example, a 1 m × 1.2 m plate is used. The nozzle 35 has a diameter of 2.8 mm, and the angle $\beta$ of the plate 30 with respect to the horizontal plane is 30°. The diameter of the carrier particles 33 is 0.2 to 0.5 mm. "Grossly aspherical" are those particles which have the form of dumbbells, of little rods and the like or which consist of slag. "Somewhat aspherical" particles are particles having the form of ellipsoids or spheres with depressions and the like. The time for passing through 3 kg of granulated material is about 36 minutes.

Figure 3B:
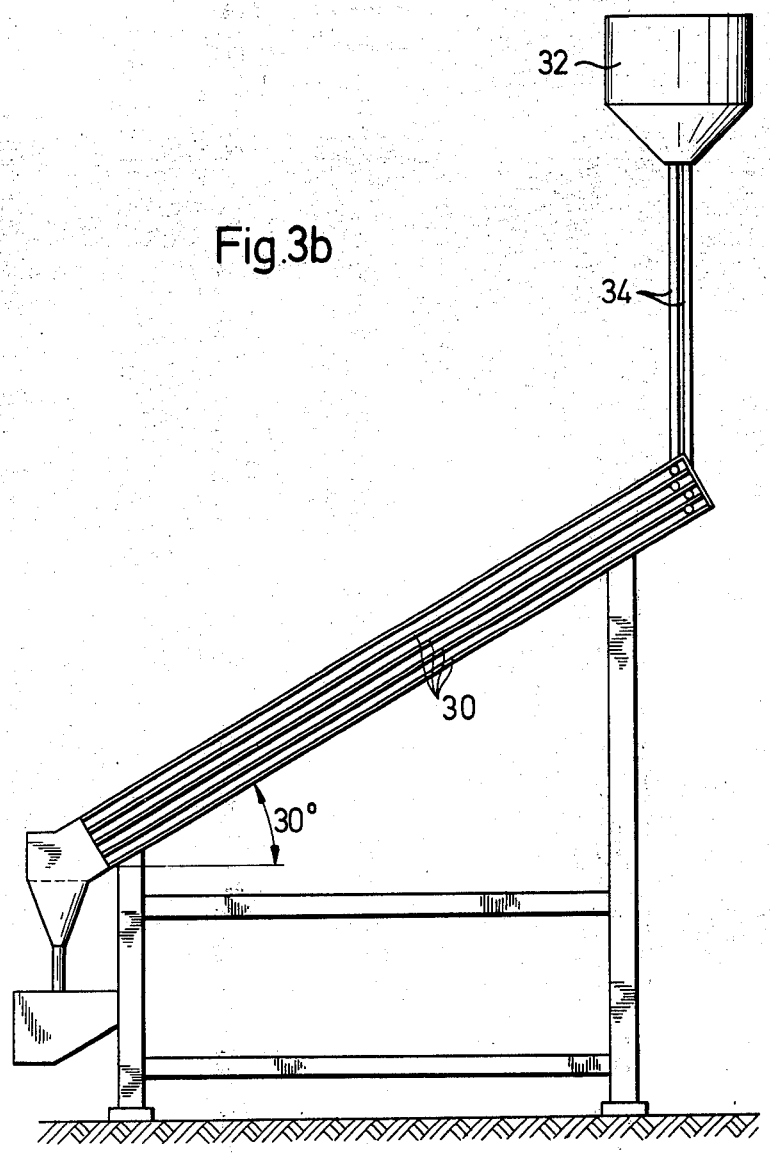
FIG. 3*b* is a side elevational view of an apparatus according to FIG. 3*a* with several plates.
Figure 5:
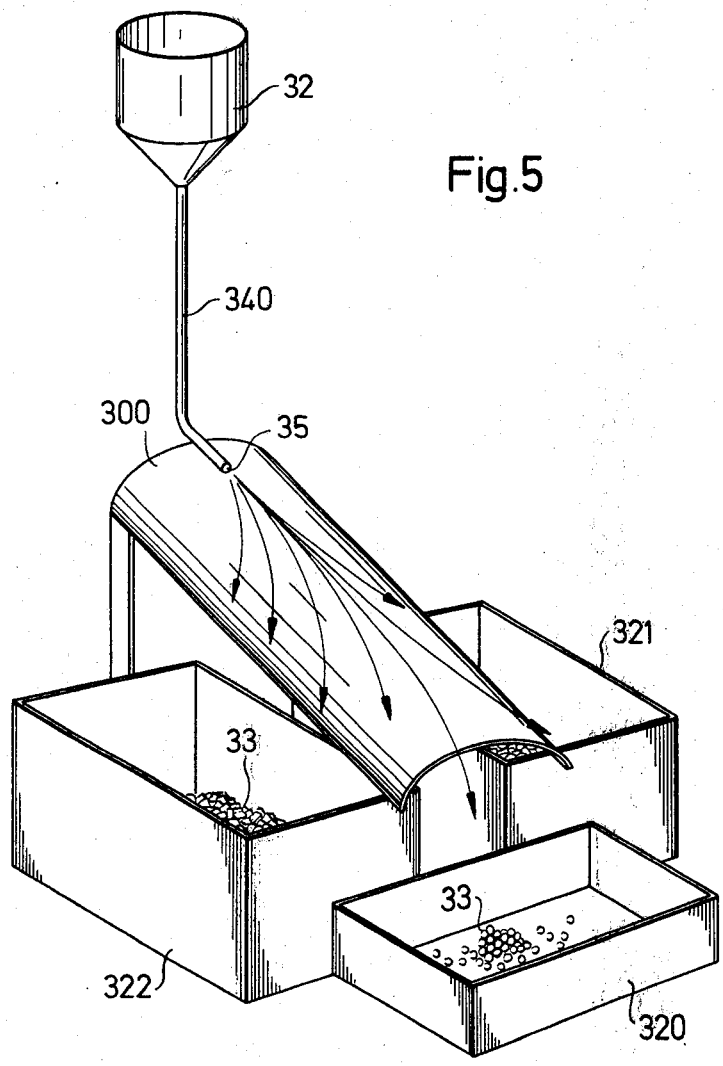
FIG. 5 is a perspective view of a further apparatus for performing the invention.

In the embodiment described immediately above, a considerably increased throughput can be achieved in a space-saving manner when several plates 30 arranged closely one above the other are used. Such an embodiment is shown in FIG. 3*b*. In the apparatus illustrated in FIG. 5, the carrier material is caused to stream from the funnel 32 through a PVC tube 340 to the nozzle 35. The carrier material leaves this nozzle 35 and streams over the cylindrical surface 300. An aluminium semicylinder may be used with its axis arranged obliquely to the horizontal plane. The material leaves the nozzle 35 approximately parallel to the cylinder axis. At the front end of the semicylinder 300, the material is collected in the container 320. Separate containers 321 and 322 are arranged beside the semi-cylinder. The material collected in the container 320 is enriched with round (spherical) particles, whereas the containers 321 and 322 are enriched with aspherical particles. The separation by means of a semicylinder 300 having a diameter of 10.8 cm and a length of 15 cm is satisfactory at an inclination angle of 20°.

As a further feature of the invention, the separated spherical particles of carrier material may be provided with a coating of polymeric material. The procedure for providing such a coating, as well as the polymeric material suitable for this purpose are well known in the art.

What is claimed is:

1. An apparatus for separating spherical particles from aspherical particles in an admixture thereof, comprising:

a. a base member;

b. a plurality of planar members substantially parallel to one another and spaced apart from one another, said plurality of planar members being secured to said base member at an inclined angle with respect to horizontal;

c. means, operatively associated with each planar member of said plurality of planar members, for directing said mixture of particles upon the associated planar member;

d. means, operatively associated with each planar member of said plurality of planar members, for producing a relative velocity between the associated planar member, on the one hand, and said particles, on the other hand, each relative velocity producing means including means for impinging said particles onto said planar member at a relative velocity having a principal directional component approximately normal to the steepest inclination gradient of the associated planar member; the plurality of particle impinging means including a storage vessel for said particles elevated above said planar members and conduit means communicating with the inside of said vessel and leading to said planar members, each conduit means including outlet means angularly bent in the direction of the plane of each planar member; and e. means positioned relative to said plurality of planar members for collecting a portion of said particles in a zone of said planar members wherein predominantly spherical particles have accumulated as a result of their greater tendency to roll in response to said relative velocity than said aspherical particles.

* * * * *